US010441963B2

(12) United States Patent
Hoefte et al.

(10) Patent No.: US 10,441,963 B2
(45) Date of Patent: Oct. 15, 2019

(54) LIQUID DISPENSING PRODUCT HAVING A SPRAY DISPENSER HAVING A TRIGGER LOCK

(71) Applicant: The Procter & Gamble Company, Cincinnati, OH (US)

(72) Inventors: Paulus Antonius Augustinus Hoefte, Astene (BE); Pieter Paul Dirk Jenny Maria Vandenbergh, St. Martens Latem (BE); Vincent Hubert M. De Wilde, Kessel-Lo (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/883,489

(22) Filed: Jan. 30, 2018

(65) Prior Publication Data

US 2019/0232310 A1 Aug. 1, 2019

(51) Int. Cl.
*B05B 11/00* (2006.01)

(52) U.S. Cl.
CPC ..... *B05B 11/0032* (2013.01); *B05B 11/3057* (2013.01); *B05B 11/3073* (2013.01)

(58) Field of Classification Search
CPC ..... B05B 11/0032; B05B 11/3057; B05B 11/3073

(Continued)

(56) References Cited

U.S. PATENT DOCUMENTS 4,819,835 A * 4/1989 Tasaki ..... B05B 11/3011 222/383.1

5,482,186 A * 1/1996 Rodden, Jr. ..... B05B 11/0029 222/153.07

(Continued)

FOREIGN PATENT DOCUMENTS

EP 1524039 B1 11/2006
EP 3097983 A4 1/2018

(Continued)

OTHER PUBLICATIONS

Extended European Search Report for Application No./Patent No. 19153270.4-1010, dated Jul. 2, 2019, 9 pages.

*Primary Examiner* — Benjamin R Shaw
(74) *Attorney, Agent, or Firm* — Gary J. Foose

(57) ABSTRACT

A liquid dispensing product having: a lockable spray dispenser and a liquid composition, the spray dispenser configured to spray the composition. The spray dispenser having a shroud housing a pump, the shroud having a shroud top surface; a rotatable nozzle cover housing a discharge nozzle, the discharge nozzle in fluid communication with the pump; a trigger operatively engaged with the pump, the trigger having a trigger front surface facing away from the shroud and an opposing trigger back surface and a pair of opposing trigger lateral edges; a projection extending outwardly from the nozzle cover; and a projection engaging surface on the trigger back surface. The projection is rotatably engageable with the projection engaging surface. The entirety of the projection is below the shroud top surface, behind the trigger back surface, and between the trigger lateral edges when the projection is engaged with the projection engaging surface and when the projection is disengaged with said projection engaging surface. The liquid composition having from about 5% to about 15%, by weight of the composition, of a surfactant system.

10 Claims, 10 Drawing Sheets

(58) Field of Classification Search
USPC ..... 222/153.11
See application file for complete search history.

(56) References Cited

U.S. PATENT DOCUMENTS

| | | | | |
|---|---|---|---|---|
| 6,006,950 | A * | 12/1999 | Watanabe | B05B 11/0029 222/153.13 |
| 6,669,058 | B1 | 12/2003 | Sweeton | |
| 7,017,833 | B2 * | 3/2006 | Foster | B05B 1/12 222/383.1 |
| 8,757,447 | B2 | 6/2014 | Gill et al. | |
| 2005/0082311 | A1 * | 4/2005 | Good | B05B 11/3057 222/1 |
| 2006/0113327 | A1 | 6/2006 | Walters et al. | |
| 2008/0191061 | A1 * | 8/2008 | Inaba | B05B 11/0029 239/533.1 |
| 2015/0252302 | A1 * | 9/2015 | Rieth | C11D 3/2072 514/772 |
| 2016/0221735 | A1 * | 8/2016 | Gatteschi | B65D 71/08 |

FOREIGN PATENT DOCUMENTS

| | | | |
|---|---|---|---|
| JP | 3905609 | B2 | 9/1997 |
| JP | H10146545 | A | 6/1998 |
| JP | 2001287763 | A | 10/2001 |
| JP | 3583246 | B2 | 8/2004 |
| JP | 3730027 | B2 | 10/2005 |
| JP | 3730029 | B2 | 10/2005 |
| JP | 3770445 | B2 | 2/2006 |
| JP | 3883164 | B2 | 11/2006 |

* cited by examiner

LIQUID DISPENSING PRODUCT HAVING A SPRAY DISPENSER HAVING A TRIGGER LOCK

FIELD OF THE INVENTION

Locking mechanism for the mechanical inhibition of a trigger of a spray dispenser of a liquid dispensing product.

BACKGROUND OF THE INVENTION

Liquid products, particularly household and fabric care compositions such as dishwashing soap, hand soap, and surface cleaners, are a popular choice among consumers. Generally such liquids are sold within containers attached to trigger actuated spray dispensers and are called liquid dispensing products. Trigger spray dispensers attached to containers allow for the liquid within the container to flow from within the container to a targeted surface with minimal physical exertion by the user. Traditional trigger spray dispensers may have a spray nozzle attached to a shroud housing a pump, and a trigger having for example, a trigger lever, underneath the spray nozzle. The shroud is then attached to a container holding the liquid. The trigger lever is typically found beneath the spray nozzle because as a user grips the product, the user can hold the entire product and actuate the trigger spray dispenser with only one hand. A user will typically place their hand around the neck of the container with the user's index finger and possibly middle finger on the trigger lever and the user's thumb, ring finger, and pinky wrapped underneath the trigger lever. In this configuration, the user may easily point the spray dispenser towards the targeted surface the user wishes to spray and press on the trigger with the user's fingers.

Manufacturers want to ensure that trigger spray dispensers are convenient to operate without too much force being necessary to actuate the spray dispenser, so as not to potentially cause the user to strain their finger. Manufacturers also do not want the spray dispenser to be actuated inadvertently by an accidental bump of the trigger lever, so as not to potentially cause liquid to be sprayed where the user did not intend for the liquid to be sprayed or in the case of a child getting ahold of the product. Manufacturers also want for the spray dispenser to maintain its product integrity during shipping, storage, and/or display on a store shelf. As such, manufacturers have added different locking mechanisms to the trigger spray dispensers.

One way manufacturers have attempted to solve the problem of accidental actuation of the spray dispenser is by blocking the nozzle flow pathway. Blocking the nozzle flow pathway can be accomplished by several different means, including having a barrier move in front of the nozzle orifice or move in between the nozzle flow pathway blocking liquid from flowing to the nozzle orifice. The barrier can be operatively engaged with the nozzle cover such that when the user rotates the nozzle cover, the barrier moves into place to block liquid flow. In some executions, the trigger lever may still be movable. When in the locked position, it has been found that some residual quantity of liquid remains within the nozzle such that even in a locked position, actuation of the trigger may produce a minor amount of unwanted discharge. A user, a child, or another outside force, may cause the trigger to depress and some of the residual liquid may discharge. Even if this residual liquid does not discharge, once the barrier is removed and a user tries to use the spray dispenser, an uneven stream of liquid may be discharged as there may be uneven liquid and air built-up in the nozzle.

Furthermore, a spray dispenser locking mechanism involving a barrier to the nozzle flow path may be undesirable in trigger spray dispensers having buffer systems. When a buffer system is present, each actuation of the trigger may result in an increase of liquid into the buffer system. This increase of liquid into the buffer system may lead to greater pressure in the buffer system until the liquid is discharged through the nozzle. When there is a barrier to the nozzle flow path and the trigger is capable of being actuated, even slightly, more liquid will move into the buffer system and the pressure will increase. Too high a pressure build-up may damage the spray dispenser system. Additionally, a pressure build-up may result in undesirable spray patterns as the pressure may affect the particle size upon spraying of the liquid, which may lead to an unintended more mist-like spray pattern.

To solve the problems that arise in spray dispensers having spray dispenser locking mechanisms involving barriers to the nozzle flow path, manufacturers have designed spray dispenser locking mechanisms involving the trigger being locked or unable to depress, and as such the spray dispenser is unable to actuate. One such method is by placing a bar overlying the trigger lever such that the bar may block a user's access to the trigger lever. A user may rotate the bar in front of or behind the trigger lever to lock the trigger spray dispenser and then rotate the bar away from the trigger lever to unlock the trigger spray dispenser. However, a bar of this type of locking mechanism may break if another object comes into contact with the bar. The bar may also interfere with the user's fingers and thus negatively impact the user's product experience depending on the configuration of the product. Additionally, the bar may be visually unappealing to the aesthetics of the product.

In view of the above, there is a continuing unaddressed need for a liquid dispensing product having a spray dispenser having a trigger locking mechanism and method of using such spray dispenser having a trigger locking mechanism to mechanically inhibit the trigger from actuating the trigger spray dispenser where the locking mechanism will not easily come into contact with an outside force causing it to break or become damaged, will not affect the user's product experience by interfering with where the user's fingers are placed, and is visually appealing to a user.

SUMMARY OF THE INVENTION

A liquid dispensing product comprising a spray dispenser and a liquid composition, wherein the spray dispenser is configured to spray the composition. The spray dispenser comprising a shroud housing a pump, wherein the shroud comprises a shroud top surface; a rotatable nozzle cover housing a discharge nozzle, wherein the discharge nozzle is in fluid communication with the pump; a trigger operatively engaged with the pump, the trigger having a trigger front surface facing away from the shroud and an opposing trigger back surface and a pair of opposing trigger lateral edges; a projection extending outwardly from the nozzle cover; and a projection engaging surface on the trigger back surface. The projection may be rotatably engageable with the projection engaging surface. The entirety of the projection may be below the shroud top surface, behind the trigger back surface, and between the trigger lateral edges when the projection is engaged with the projection engaging surface and when the projection is disengaged with the projection engaging surface. The liquid composition comprising from about 5% to about 15%, by weight of the composition, of a surfactant system. Further, an assembly of the liquid dispensing products. Further, a method of shipping one or more of the liquid dispensing products comprising the step of facilitating the transfer of one or more of the liquid dispensing products from a first geographical address to a second geographical address, wherein one or more of the liquid dispensing products is locked.

DETAILED DESCRIPTION OF THE INVENTION

Figure 1:
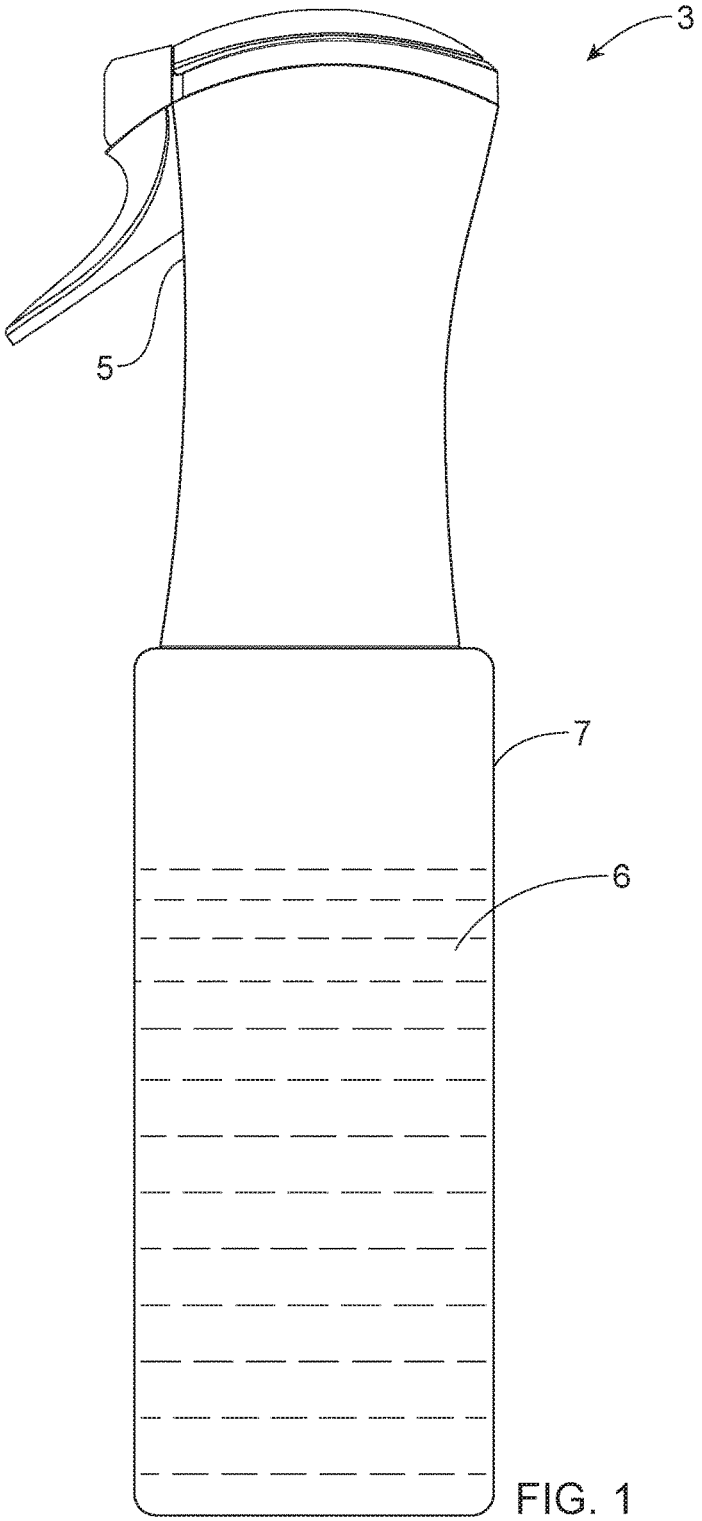
FIG. 1 shows a side view of a liquid dispensing product having a spray dispenser and a liquid composition within a container attached to the spray dispenser.
Figure 2:
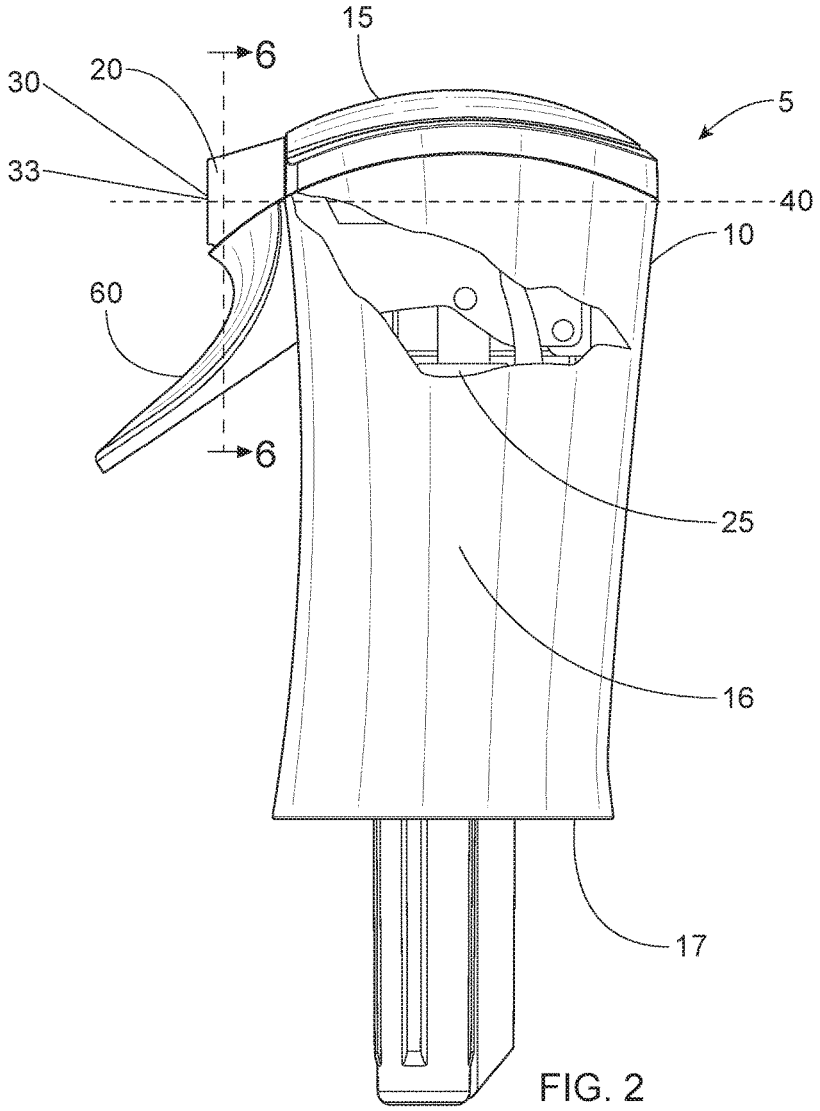
FIG. 2 shows a side view having a cutout of a spray dispenser.

FIG. 1 shows a side view of a liquid dispensing product 3 comprising a spray dispenser 5 and a liquid composition 6 within a container 7 attached to the spray dispenser 5. FIG. 2 shows the side view of a spray dispenser 5. The spray dispenser 5 may comprise a shroud 10 housing a pump 25. A portion of the shroud 10 in FIG. 2 is partially cut away to show a pump 25. The shroud 10 has a shroud top surface 15, a shroud bottom edge 17 opposing the shroud top surface 15, and shroud walls 16 connecting the shroud top surface 15 to the shroud bottom edge 17. The spray dispenser 5 may comprise a rotatable nozzle cover 20 housing a discharge nozzle 30. The nozzle 30 may comprise a nozzle orifice 33 where liquid may ultimately exit the spray dispenser 5. The nozzle orifice 33 may be an opening in which the liquid ultimately exits the spray dispenser 5 as it moves through the nozzle 30 and nozzle flow pathway. The nozzle orifice 33 may be the opening at the end of the nozzle flow pathway that is further in distance from the pump 25 or further in distance from the container 7 than the other end of the nozzle flow pathway. The nozzle cover 20 may be rotatable about a central axis 40. The nozzle cover 20 may be rotatable about a central axis 40 thereof between a discharge unlocked position and a discharge locked position, as detailed further in FIGS. 4, 5, 6, and 7. The discharge nozzle 30 may extend from the shroud 10. The discharge nozzle 30 may be in fluid communication with the pump 25. The spray dispenser 5 may comprise a trigger 60. The trigger 60 may be operatively engaged with the pump 25.

Figure 3:
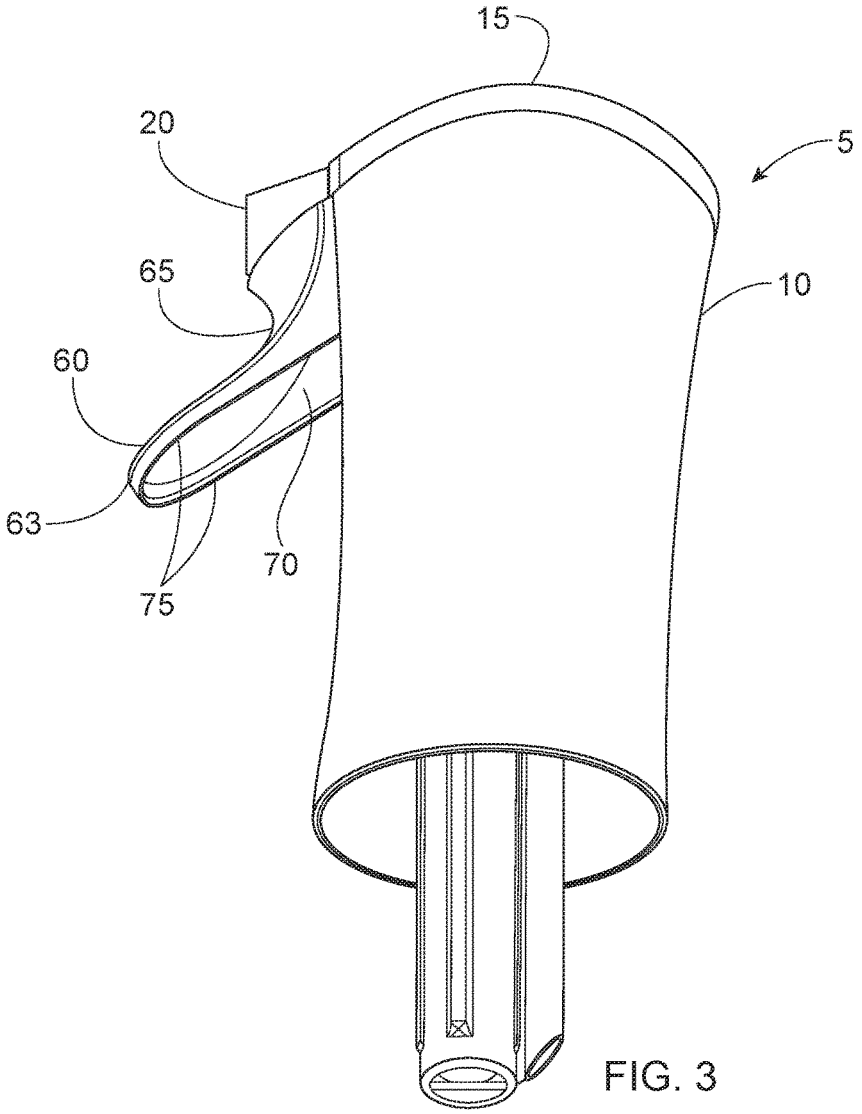
FIG. 3 shows a perspective view of a spray dispenser.

FIG. 3 shows a perspective view of a spray dispenser 5. The spray dispenser 5 may comprise a trigger 60 operatively engaged with the pump 25 (not shown). The trigger 60 may have a trigger front surface 65. The trigger front surface 65 faces away from the shroud 10. The trigger 60 may have an opposing trigger back surface 70. The trigger 60 may have a pair of opposing trigger lateral edges 75. The trigger 60 may comprise a movable part 63 operatively engaged with a means of releasing the movable part (not shown).

Figure 4:
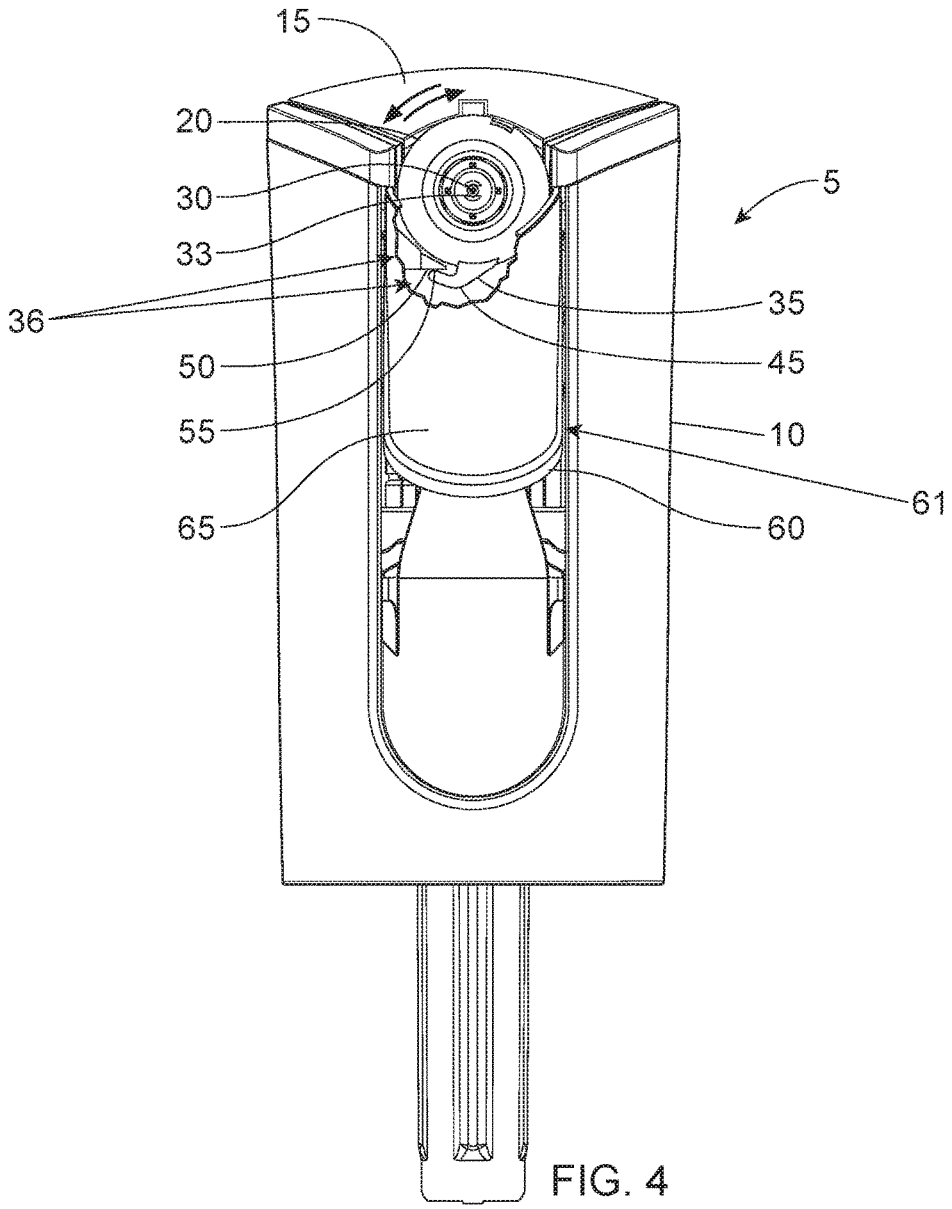
FIG. 4 shows a front view of a spray dispenser where the projection and projection engaging surface are engaged and the trigger is relaxed.

FIG. 4 shows a front view of a spray dispenser 5 having a partial cutout of the trigger 60 so as to see behind the trigger front surface 65. The spray dispenser 5 may comprise a projection 35. The projection 35 may extend outwardly from the nozzle cover 20. The spray dispenser 5 may comprise a projection engaging surface 50. The projection engaging surface 50 may be on the trigger back surface 70. The projection engaging surface 50 may extend outwardly from the trigger back surface 70. The projection 35 may comprise a hook 45. The projection engaging surface 50 may comprise a tab 55.

The partial cutout of the trigger 60 shown in FIG. 4 depicts the projection 35 engaged with the projection engaging surface 50. FIG. 4 further depicts the trigger 60 is relaxed. The spray dispenser 5 may comprise a trigger first position 61 wherein the trigger 60 is relaxed, or is in a state of rest as there is no or substantially no active force being placed on the trigger 60.

The nozzle cover 20 may be rotatable about a central axis 40 between a discharge locked position 36 and a discharge unlocked position. The discharge unlocked position is detailed further in FIGS. 5, 6, and 7. The projection 35 may be rotatably engageable with the projection engaging surface 50. When the projection 35 and the projection engaging surface 50 are engaged, the spray dispenser 5 is in the discharge locked position 36, and the trigger 60 is unable to be actuated, or depressed, and as such, the spray dispenser 5 is in the trigger first position 61. The projection 35 may be engaged with the projection engaging surface 50 when the spray dispenser 5 is in the trigger first position 61, as the projection engaging surface 50 is an extension of the trigger back surface 70 and when the spray dispenser 5 is in the trigger first position 61, the projection engaging surface 50 is placed where the projection engaging surface 50 is capable of engaging with the projection 35.

It is common that the spray dispenser 5 is in the trigger first position 61 and in the discharge locked position 36 when the user first finds the liquid dispensing product 3 on a store shelf and after a user finishes using the liquid dispensing product 3 and desires to keep the spray dispenser 5 from accidentally actuating and discharging fluid, and thus rotates the nozzle cover 20 to engage the projection 35 with the projection engaging surface 50 resulting in the discharge locked position 36.

Figure 5:
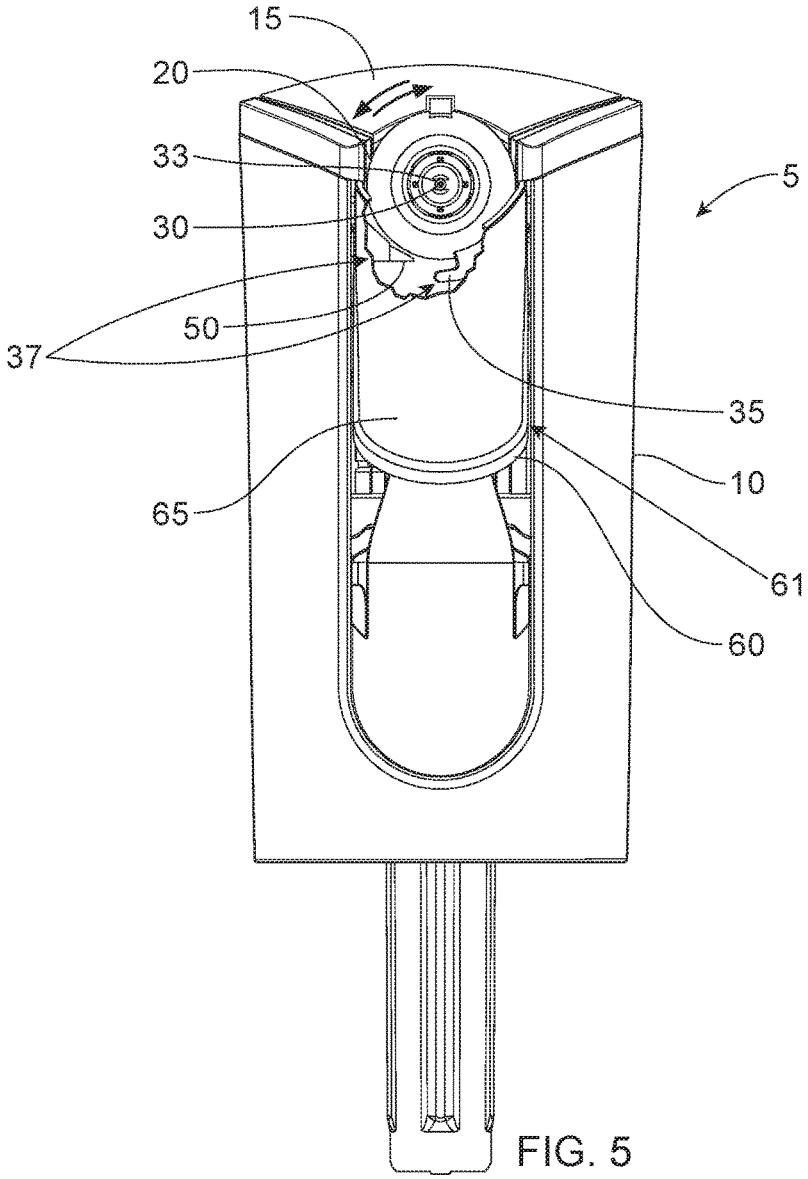
FIG. 5 shows a front view of a spray dispenser where the projection and projection engaging surface are disengaged and the trigger is relaxed.

FIG. 5 shows a front view of a spray dispenser 5 where the projection 35 and projection engaging surface 50 are disengaged and the trigger 60 is relaxed, or in the trigger first position 61.

The nozzle cover 20 may be rotatable about a central axis 40 between a discharge locked position 36, as detailed above in FIG. 4, and a discharge unlocked position 37. The projection 35 may be disengaged from the projection engaging surface 50 by rotating the nozzle cover 20 in a direction to disengage the projection 35 and the projection engaging surface 50. When the projection engaging surface 50 and the projection 35 are disengaged, the spray dispenser 5 may be in the discharge unlocked position 37, and the trigger 60 is able to be actuated, or depressed, by a sufficient outside force.

Figure 6:
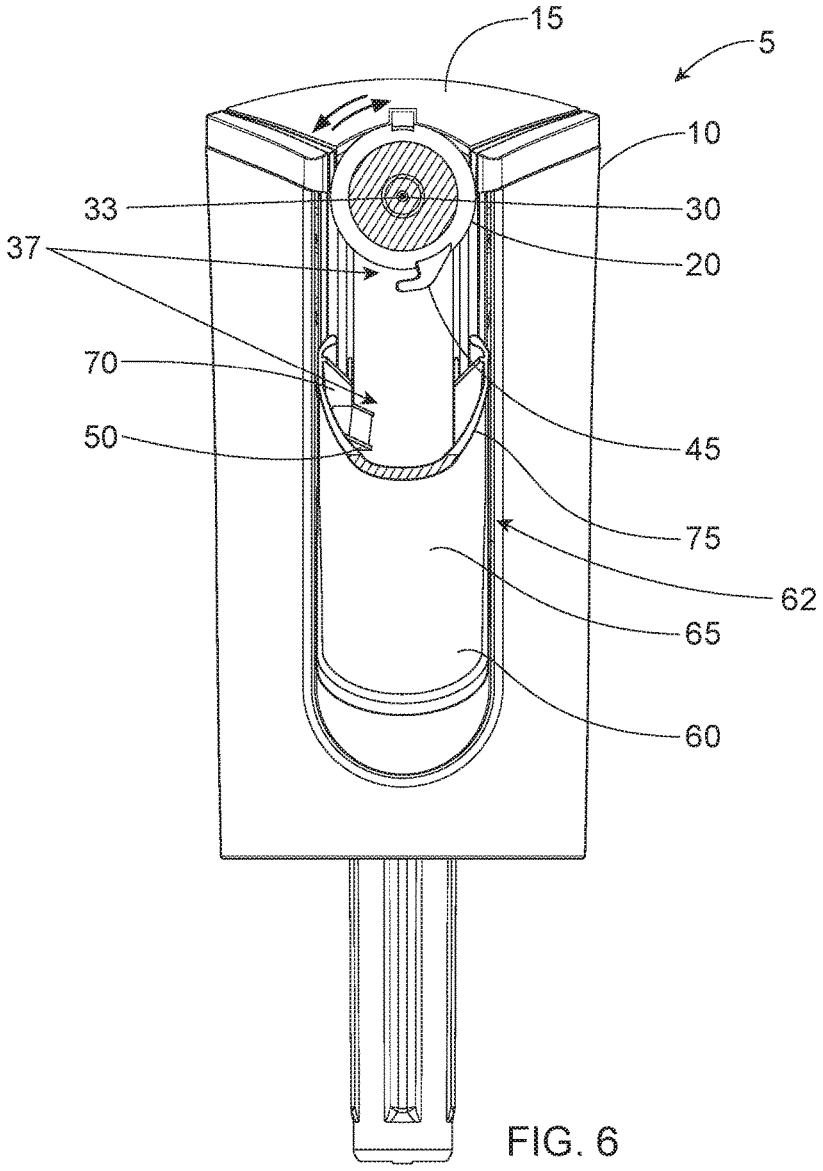
FIG. 6 shows a partial cross-sectional front view of a spray dispenser.
Figure 7:
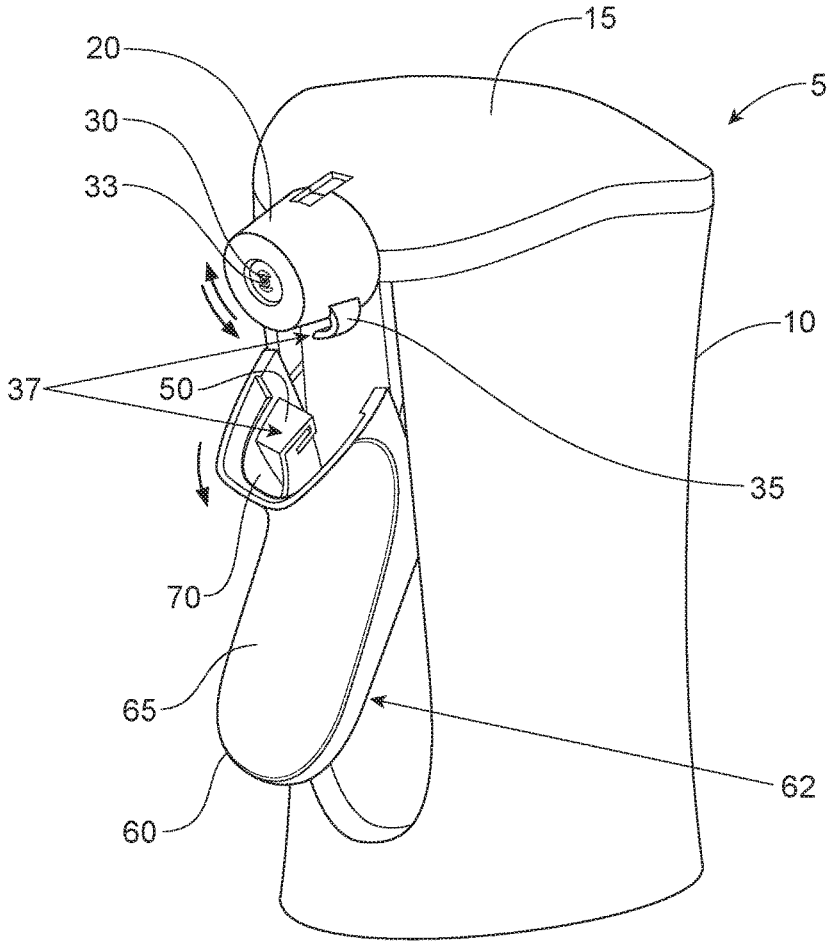
FIG. 7 shows an isometric view of a spray dispenser where the projection and projection engaging surface are disengaged and the trigger is depressed.

When the spray dispenser 5 is in the discharge unlocked position 37, the trigger 60 may in the trigger first position 61, or relaxed, as shown in FIG. 5, or the trigger 60 may be in the trigger second position 62, or depressed, as further detailed in FIGS. 6 and 7.

It is common that the spray dispenser 5 is in the trigger first position 61 and in the discharge unlocked position 37 when the user desires to use the liquid dispensing product 3 and first rotates the nozzle cover 20 to disengage the projection 35 with the projection engaging surface 50, or to go from the discharge locked position 36 shown in FIG. 4 to the discharge unlocked position 37 shown in FIG. 5. As the user is first rotating the nozzle cover 20, the trigger 60 will be in the trigger first position 61, or relaxed, as the projection 35 and the projection engaging surface 50 are in the process of disengaging, as the trigger 60 cannot be depressed until the projection 35 and the projection engaging surface 50 are disengaged. The spray dispenser 5 may also be in the trigger first position 61 and in the discharge unlocked position 37 if the user decides not to re-engage the projection 35 and the projection engaging surface 50 after use of the liquid dispensing product 3. When the spray dispenser 5 is in the trigger first position 61 and in the discharge unlocked position 37, the spray dispenser 5 is capable of being accidentally actuated by a sufficient outside force that may come into contact and actuate the trigger 60, such as accidentally by a child pushing down on the trigger 60.

FIG. 6 shows a partial cross-sectional front view of a spray dispenser 5 taken along the line 6-6 of FIG. 2 where the projection 35 and the projection engaging surface are disengaged, or in the trigger unlocked position 37, and the trigger 60 is depressed, or actuated. The spray dispenser 5 may comprise a trigger second position 62 wherein the trigger 60 is depressed, or is in a state of unrest as the trigger 60 may have a large enough outside force to depress the trigger 60.

When the spray dispenser 5 is in the trigger unlocked position 37, the trigger 60 may be capable of transitioning from the trigger first position 61, as depicted above in FIG. 5, to the trigger second position 62, as depicted in FIG. 6. When the spray dispenser 5 is in the trigger second position 62, the projection 35 and the projection engaging surface 50 are disengaged, or in the trigger unlocked position 37, as when an outside force capable of depressing the trigger 60 is placed on the trigger 60, the projection engaging surface 55, as an extension of the trigger back surface 75, may move with the trigger 60, rather than being physically blocked from motion by the projection 35.

It is common that the spray dispenser 5 is in the trigger second position 62 and in the discharge unlocked position 37 when the user is actuating the spray dispenser 5. To actuate the spray dispenser 5, the user first places a force on the trigger 60, commonly by using the user's hand to press down and actuate the trigger 60, and as such the trigger 60 moves to a depressed state, i.e., is in the trigger second position 62. This actuation of the trigger 60 in turn actuates the pump 25 and thus the spray dispenser 5 becomes actuated and liquid may move from within the container 7 of the liquid dispensing product 3 to the spray dispenser 5 to outside of the liquid dispensing product 3 through the nozzle 30.

FIG. 7 shows an isometric view of the spray dispenser 5 of FIG. 6, wherein the projection 35 and projection engaging surface 50 are disengaged, or in the discharge unlocked position 37, and wherein the trigger 60 is depressed, or in the trigger second position 62. The trigger 60 may be movable in at least an axially downward direction, as shown by the arrow in FIG. 7, as the trigger 60 is acted upon by a force sufficient to depress the trigger 60.

Figure 8:
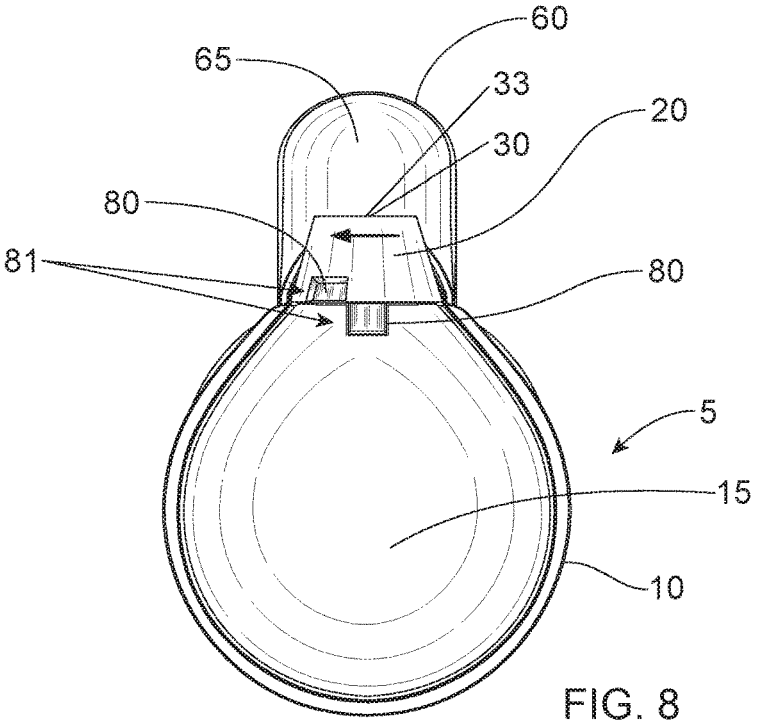
FIG. 8 shows a top view of a spray dispenser having an indicator on the shroud top surface and on the nozzle cover where the indicator is in the indicator locked position.

FIG. 8 shows a top view of a spray dispenser 5 having an indicator 80 on the shroud top surface 15 and on the nozzle cover 20. The indicator 80 may comprise an indicator locked position 81. The indicator locked position 81 may be misaligned to indicate that the spray dispenser 5 is not ready for use or that the trigger 60 is mechanically inhibited from actuation. When the indicator 80 is in the indicator locked position 81, the projection 35 may be engaged with the projection engaging surface 50, or may be in the discharge locked position 36.

Figure 9:
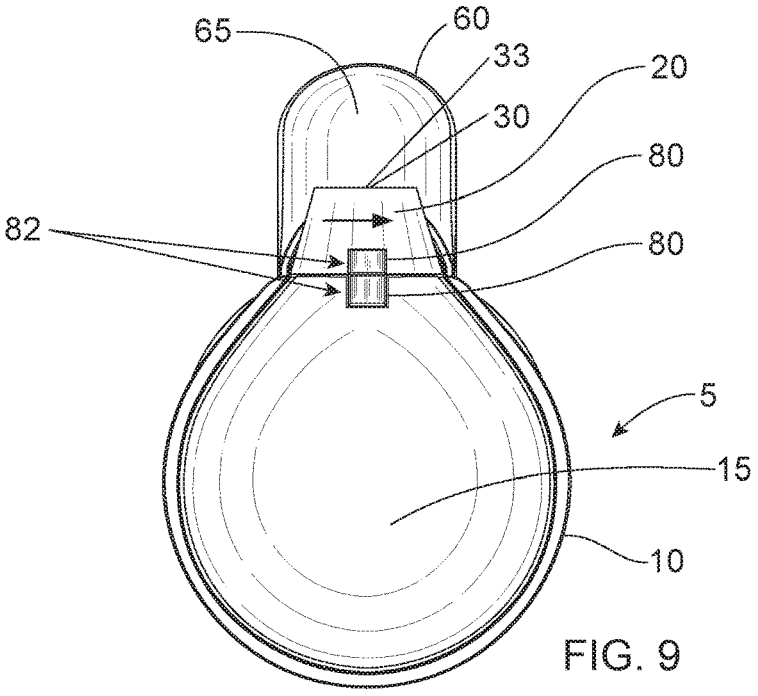
FIG. 9 shows a top view of a spray dispenser having an indicator on the shroud top surface and on the nozzle cover where the indicator is in the indicator unlocked position.

FIG. 9 shows a top view of a spray dispenser 5 having an indicator 80 on the shroud top surface 15 and on the nozzle cover 20. The indicator 80 may comprise an indicator unlocked position 82. The indicator unlocked position 82 may be aligned to indicate that the spray dispenser 5 is ready for use or that the trigger 60 is not mechanically inhibited from actuation or able to be depressed. When the indicator 80 is in the indicator unlocked position 82, the projection 35 may be disengaged with the projection engaging surface 50, or may be in the discharge unlocked position 37.

Figure 10:
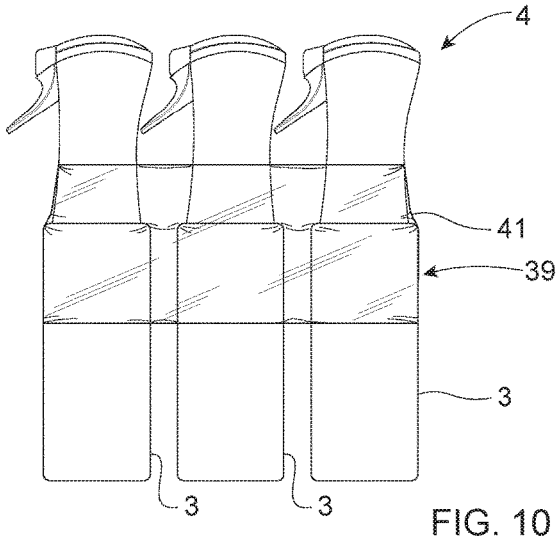
FIG. 10 shows an assembly of liquid dispensing products where at least one liquid dispensing product is partially in contact with a shipping material, wherein the shipping material is shipping wrap.

FIG. 10 shows an assembly of liquid dispensing products 4 where at least one liquid dispensing product 3 is partially in contact with a shipping material 39, wherein the shipping material 39 is shipping wrap 41.

Figure 11:
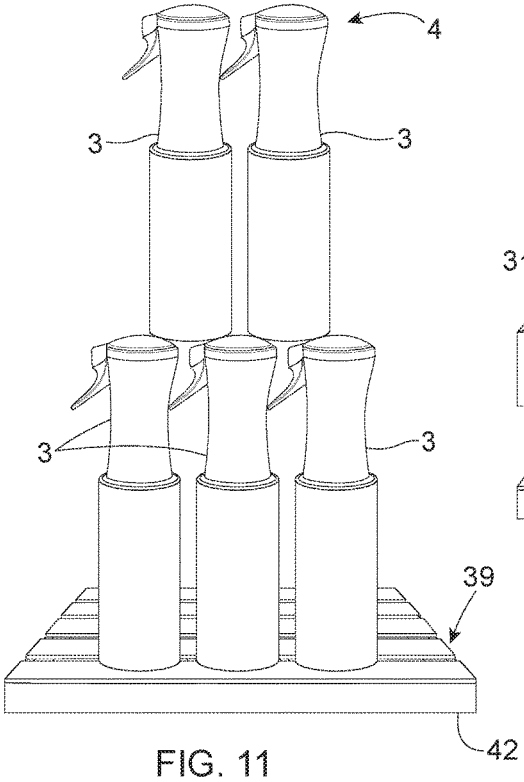
FIG. 11 shows an assembly of liquid dispensing products where at least one liquid dispensing product is at least partially in contact with a shipping material, wherein the shipping material is a receptacle and at least one of the liquid dispensing products is placed at least partially on top of and/or within the receptacle.

FIG. 11 shows an assembly of liquid dispensing products 4 where at least one liquid dispensing product 3 is at least partially in contact with a shipping material 39, wherein the shipping material 39 is a receptacle 42 and at least one of the liquid dispensing products 3 is placed at least partially on top of and/or within the receptacle 42.

Figure 12:
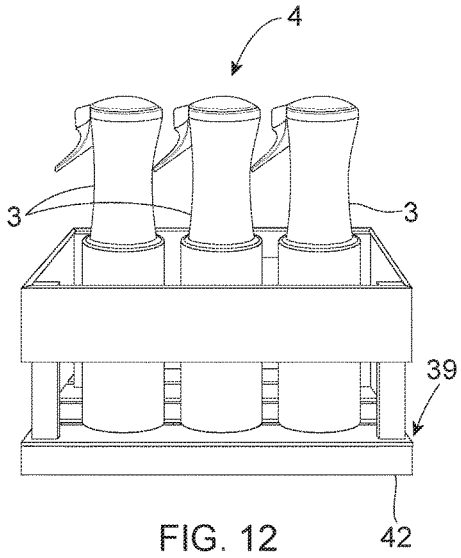
FIG. 12 shows an assembly of liquid dispensing products where all of the individual liquid dispensing products are at least partially in contact with a shipping material, wherein the shipping material is a receptacle and all of the individual liquid dispensing products are placed at least partially on top of and/or within the receptacle.

FIG. 12 shows an assembly of liquid dispensing products 4 where all of the individual liquid dispensing products 3 are at least partially in contact with a shipping material 39, wherein the shipping material 39 is a receptacle 42 and all of the individual liquid dispensing products 3 are placed at least partially on top of and/or within the receptacle 42.

Figure 13:
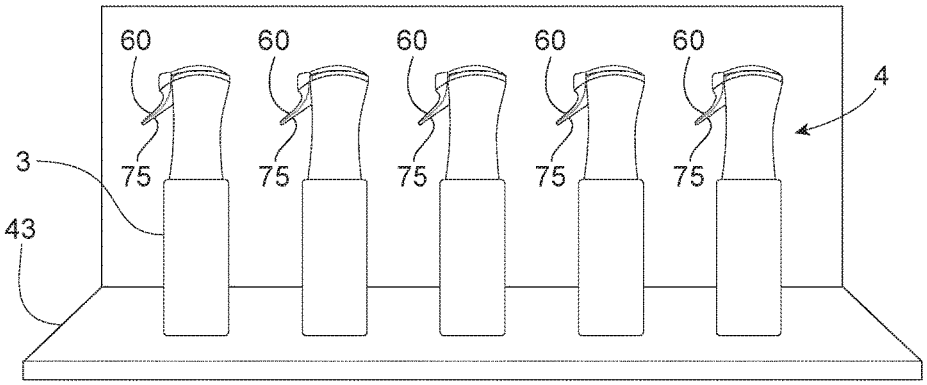
FIG. 13 shows an assembly of liquid dispensing products on a shelf.

FIG. 13 shows an assembly of liquid dispensing products 4 on a shelf 43.

Figure 14:
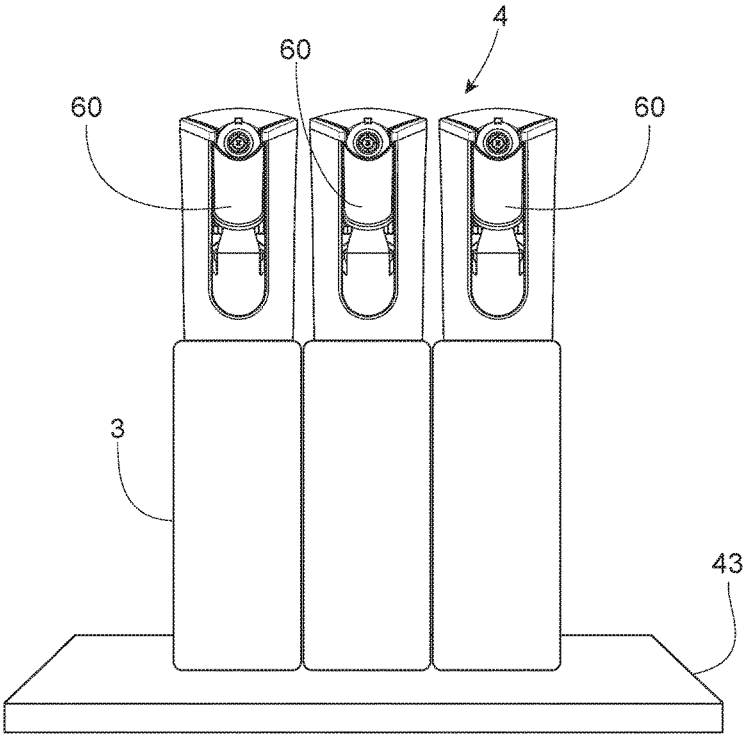
FIG. 14 shows an assembly of liquid dispensing products on a shelf.

FIG. 14 shows an assembly of liquid dispensing products 4 on a shelf 43.

Liquid Dispensing Product

FIG. 1 shows a liquid dispensing product 3. The liquid dispensing product 3 may comprise a spray dispenser 5 and a liquid composition 6, wherein the spray dispenser 5 is configured to spray the liquid composition 6. The liquid dispensing product 3 may further comprise a container 7. The liquid composition 6 may be housed within the container 7 prior to any use of the liquid dispensing product 3 and prior to any actuation of the spray dispenser 5. A user may actuate the spray dispenser 5 and the liquid composition 6 may flow from within the container 7 to the spray dispenser 5 and out of the liquid dispensing product 3 through a nozzle orifice 33 onto a targeted surface outside of the liquid dispensing product 3.

Spray Dispenser

The spray dispenser 5 may comprise a shroud 10, a pump 25, a discharge nozzle 30, and a trigger 60. The spray dispenser 5 may be a trigger spray dispenser. The spray dispenser 5 may be any trigger spray dispenser known to one skilled in the art capable of moving liquid, such as a liquid composition, from a container onto a targeted surface outside a liquid dispensing product by use of a trigger. The spray dispenser 5 may be a continuous flow trigger spray dispenser. The spray dispenser 5 may be an automatic trigger spray dispenser. The spray dispenser 5 may be a manual trigger spray dispenser. The spray dispenser 5 be a pre-compression trigger spray dispenser. The spray dispenser 5 may have a buffer system.

Shroud and Pump

As shown in FIG. 2, the spray dispenser 5 may comprise a shroud 10. The shroud 10 may house a pump 25. The shroud 10 may partially house a pump 25. The shroud 10 may cover a pump 25 to protect the pump 25 from contact with an outside force. The shroud 10 may house or may partially house any other component typically found in a trigger spray dispenser, such as, for example, a buffer system or a connecting piece to connect the shroud 10 to a container 7.

The shroud 10 may comprise a shroud top surface 15. The shroud top surface 15 may obscure the pump 25 from view from at least one direction. The shroud top surface 15 may obscure the pump 25 from view from the top direction.

The shroud 10 may comprise a shroud bottom edge 17 opposing the shroud top surface 15. The shroud 10 may comprise shroud walls 16 connecting the shroud top surface 15 to the shroud bottom edge 17. The shroud walls 16 may surround the pump 25. The shroud walls 16 may partially surround the pump 25. The shroud top surface 15 may lie perpendicular to the shroud walls 16.

The shroud 10 may be of slightly cylindrical or cylindrical shape. The shroud 10 may be of any shape known by one skilled in the art to partially house or house a pump 25. The shroud 10 may be made of plastic. The shroud 10 may be made of any material known to one skilled in the art capable of forming a shroud for a trigger spray dispenser 5 such as that of the current invention. The shroud 10 may be of any shape and curvature to enable ease of gripping by a user. The shroud 10 may comprise gripping features, such as, but not limited to, tapering in the midsection and ridges and/or bumps to enable gripping. Tapering in the shroud 10 may also provide a visual cue to the user as to orientation of the spray dispenser 5.

The shroud 10 may be connected to a container 7. The shroud 10 may be connected to the container 7 at the shroud bottom edge 17. When the shroud 10 is connected to the container 7, the shroud bottom edge 17 may be proximal the container 7. When the shroud 10 is connected to the container 7, the shroud bottom edge 17 may be in contact with the container 7. The shroud 10 may be screwed onto the container 7. The shroud 10 may be snapped onto the container 7.

As shown in the partial cutaway of FIG. 2, the shroud 10 may house a pump 25. The pump 25 may be any device or system of devices known to one skilled in the art capable of moving fluids, including liquids and gases, by mechanical action. The pump 25 may be any pump known to one skilled in the art used within spray dispensers, particularly trigger spray dispensers. The pump 25 may comprise a buffer system. The pump 25 may comprise a compression chamber. The pump 25 may comprise a buffer system operatively engaged with a compression chamber. The pump 25 may further comprise any other component known to one skilled in the art required for the functioning of the buffer system and/or compression chamber. The buffer system may comprise a buffer piston. The buffer system may comprise a buffer chamber. The buffer system may comprise a buffer spring. The buffer system may comprise a buffer piston, buffer chamber, and buffer spring. The buffer system may comprise any other component known to one skilled in the art required for the functioning of the buffer system. Examples of buffer systems can be found, for example, in U.S. Pat. No. 8,905,271; U.S. Pub. 2014/246506; and U.S. Pub. 2013/112766. The present invention is particularly beneficial for use in spray dispensers having buffer systems as when a spray dispenser has a buffer system, actuation of the trigger 60 may result in an increase of liquid composition 6 into the buffer system. The increase of liquid composition 6 into the buffer system may lead to greater pressure in the buffer system until the liquid composition 6 is discharged through the nozzle 30. When there is a barrier to the nozzle flow path and the trigger 60 is capable of being actuated, even slightly, more liquid composition 6 may move into the buffer system and the pressure will increase. Too high a pressure build-up may damage the spray dispenser 5 system. Additionally, a pressure build-up may result in undesirable spray patterns as the pressure may affect the particle size upon spraying of the liquid composition, which may lead to an unintended more mist-like spray pattern.

Nozzle Cover and Nozzle

The spray dispenser 5 may comprise a rotatable nozzle cover 20. The nozzle cover 20 may house a discharge nozzle 30. The nozzle cover 20 may be rotatable about a central axis 40 thereof. The nozzle cover 20 may be rotatable about a central axis 40 thereof between a discharge locked position 36, as shown in FIG. 4, and a discharge unlocked position 37, as shown in FIGS. 5, 6, and 7. The discharge locked position 36 may be wherein the projection 35 is engaged with the projection engaging surface 50 and wherein the trigger 60 is not able to actuate the pump 25. The discharge unlocked position 37 may be wherein the projection 35 is disengaged with the projection engaging surface 50 and wherein the trigger 60 is able to actuate the pump 25.

The nozzle cover 20 may house a discharge nozzle 30 to protect the nozzle 30 from contact with an outside force. The nozzle cover 20 may surround or partially surround the nozzle 30. The nozzle cover 20 may be attached to the nozzle 30 by threads. The nozzle cover 20 may be attached to the nozzle 30 by snapping pieces. The nozzle cover 20 may be attached to the nozzle 30 by any means of attachment known to one skilled in the art that enable the nozzle cover 20 to rotate. The nozzle cover 20 may be rotatable about a central axis 40 thereof. The nozzle 30 may have a central axis and the nozzle cover 20 may be rotatable about the nozzle 30 central axis. The nozzle 30 central axis may be the same as the nozzle cover 20 central axis 40. The nozzle cover 20 may be unidirectionally rotatable to the discharge locked position 36. The nozzle cover 20 may be able to only rotate in a first direction to the discharge unlocked position 37 and the nozzle cover 20 may be able to only rotate in a second direction opposing the first direction to the discharge locked position 36. The nozzle cover 20 may be rotatable about 120 degrees or less, preferably about 90 degrees or less, more preferably 60 degrees or less, most preferably about 45 degrees or less, from the discharge locked position 36 to the discharge unlocked position 37. The nozzle cover 20 may be rotatable about 120 degrees or less, preferably about 90 degrees or less, more preferably 60 degrees or less, most preferably 45 degrees or less from the discharge unlocked position 37 to the discharge locked position 36.

The nozzle cover 20 may be of slightly conical or conical shape. The nozzle cover 20 may be of slightly cylindrical or cylindrical shape. The nozzle cover 20 may be of any shape known to one skilled in the art to partially house or house the nozzle 30. The nozzle cover 20 may be made of plastic. The nozzle cover 20 may be made of any material known to one skilled in the art. The nozzle cover 20 may have gripping features such as, but not limited to, ridges and/or bumps, which may assist the user in gripping and rotating the nozzle cover 20. The nozzle cover 20 may have one or more visual cues, such as, but not limited to, text and/or arrows guiding the user to which direction the user is to rotate the nozzle cover 20 to lock and to unlock the spray dispenser 5.

The nozzle cover 20 may extend outwardly from the shroud 10. The nozzle cover 20 may be located closer to the shroud top surface 15 than to the shroud bottom edge 17. The nozzle cover 20 may be located above the trigger 60. The nozzle cover 20 may be located directly above the trigger 60.

The nozzle cover 20 may house a discharge nozzle 30. The discharge nozzle 30 may extend from the shroud 10. The nozzle 30 may comprise a nozzle orifice 33. The nozzle orifice 33 may be an opening where liquid, such as the liquid composition 6, leaves the liquid dispensing product 3 and the spray dispenser 5. The nozzle orifice 33 may connect to a nozzle flow pathway (not pictured). The nozzle flow pathway may be where liquid, such as the liquid composition 6, flows from within the spray dispenser 5 to the nozzle orifice 33. The nozzle flow pathway may be a hollow chamber. The nozzle flow pathway may be made of any material known to one skilled in the art capable of facilitating the movement of liquid from within the spray dispenser 5 to exiting the liquid dispensing product 3 and the spray dispenser 5 through the nozzle orifice 33. The nozzle flow pathway may be cylindrical. The nozzle flow pathway may be any shape known to one skilled in the art capable of facilitating the movement of liquid, such as the liquid composition 6, from within the spray dispenser 5 to exiting the liquid dispensing product 3 and the spray dispenser 5 through the nozzle orifice 33. The nozzle cover 20 may partially house the nozzle flow pathway.

The discharge nozzle 30 may be in fluid communication with the pump 25 such that, when the pump 25 is actuated, liquid flows from the container 7, through the spray dispenser 5, through the nozzle flow pathway, and through the nozzle orifice 33, ultimately exiting the liquid dispensing product 3 onto, for example, a surface.

Trigger

The spray dispenser 5 may comprise a trigger 60. The trigger 60 may be operatively engaged with the pump 25 such that actuation of the trigger 60 in turn may actuate the pump 25. The term "actuation" or any of its derivatives herein refers to the causing of the mechanism or part to operate as its intended purpose. To use the trigger 60, a user may place their finger on the trigger front surface 65 and apply force to the trigger 60 to engage the trigger 60 in actuating the pump 25. The trigger 60 may be any device or system of devices known to one skilled in the art capable of actuating the pump 25 when force is applied. The trigger 60 may be any device or system of devices known to one skilled in the art used in spray dispensers for liquid discharge.

The trigger 60 may extend from the shroud 10. The trigger 60 may be located beneath the nozzle cover 20. At least a portion of the trigger 60 may be located directly beneath the nozzle cover 20. The entire trigger 60 may be located directly beneath the nozzle cover 20. The trigger 60 may face the user when the spray dispenser 5 is facing the user. The trigger 60 may be located on either side of the shroud 10 when the spray dispenser 5 is facing the user. The trigger 60 may be hingedly connected to the pump 25. The trigger 60 may be hingedly connected to the shroud 10.

As shown in FIG. 3, the trigger 60 may have a trigger front surface 65 facing away from the shroud 10, an opposing trigger back surface 70 and a pair of opposing trigger lateral edges 75. The trigger front surface 65 may be where a user places their fingers. The trigger front surface 65 may have ridges to help the user grip the trigger 60. The trigger front surface 65 may be smooth to not cause discomfort to the user. The trigger back surface 70 may have ridges. The trigger back surface 70 may be smooth. The trigger lateral edges 75 may lie perpendicular to the trigger front surface 65. The trigger lateral edges 75 may extend such that the trigger lateral edges 75 are proximal or are in direct contact with the shroud 10.

The trigger 60 may comprise a movable part 63 operatively engaged with a means of releasing the movable part (not shown). The movable part 63 may be, for example, a lever. The means of releasing the movable part may be, for example, a catch or detent. As shown in FIG. 3, the movable part 63 may be a lever or any solid projection a user can apply pressure to in order to actuate the trigger 60. The movable part 63 may be curved for ergonomic support of a user's finger. The movable part 63 may be substantially rectangular for ease of manufacturing. The movable part 63 may have a curved free end for a visual aesthetic benefit and/or to not have sharp edges a user might find uncomfortable. The movable part 63 may be hollow. The movable part 63 may be solid. The movable part 63 may have openings extending through movable part 63.

As shown in FIGS. 4 and 5, the spray dispenser 5 may comprise a trigger first position 61 where the trigger 60 is relaxed. When the trigger 60 is relaxed, the trigger 60 does not have a large enough outside force to depress the trigger 60. When the spray dispenser 5 is in the trigger first position 61, the trigger 60 may not be actuated and in turn, the pump 25 may not actuated.

As shown in FIGS. 6 and 7, the spray dispenser 5 may comprise a trigger second position 62 where the trigger 60 is depressed. When the spray dispenser 5 is in the trigger second position 62, the trigger 60 has a large enough outside force to depress the trigger 60. When the spray dispenser 5 is in the trigger second position 62, the trigger 60 may be actuated and in turn, the pump 25 may be actuated. As shown by the arrow in FIG. 7, the trigger 60 may be movable in at least an axially downward direction.

Projection and Projection Engaging Surface

As shown in FIGS. 4, 5, 6 and 7, the spray dispenser 5 may comprise a locking mechanism to inhibit actuation of the pump 25. The locking mechanism is preferably a mechanical inhibition of the actuation of the trigger 60. The spray dispenser 5 may comprise a projection 35. The locking mechanism may comprise at least a projection 35. The spray dispenser 5 may comprise a projection engaging surface 50 for engaging with the projection 35. The projection 35 and projection engaging surface 50 may engage to create a physical barrier against movement of the trigger 60.

As shown in FIG. 4, the projection 35 may comprise a hook 45. The projection 35 may comprise a latch. The projection 35 may be of any shape known to one skilled in the art to enable the projection 35 to engage with the projection engaging surface 50. The projection 35 may be of any size, depth, width, or length known to one skilled in the art to enable the projection 35 to engage with the projection engaging surface 50. The projection 35 may be formed of plastic. The projection 35 may be formed of any material known to one skilled in the art suitable for withstanding the force placed against a trigger 60 when the projection 35 is engaged with the projection engaging surface 50 such that the projection 35 remains engaged with the projection engaging surface 50.

The projection engaging surface 50 may comprise a tab 55. The projection engaging surface 50 may comprise a ridge. The projection engaging surface 50 may be of any shape known to one skilled in the art to enable the projection 35 to engage with projection engaging surface 50. The projection engaging surface 50 may be of any size, depth, width, or length to enable the projection 35 to engage with the projection engaging surface 50. The projection engaging surface 50 may be formed of any material known to one skilled in the art suitable for withstanding the force placed against a trigger 60 when the projection 35 is engaged with the projection engaging surface 50 such that the projection 35 remains engaged with the projection engaging surface 50.

The projection 35 may be fixedly associated with the nozzle cover 20 for movement upon the rotation of the nozzle cover 20. The projection 35 may extend outwardly from the nozzle cover 20. The projection 35 may extend radially outward from the nozzle cover 20.

As shown in FIGS. 4, 5, 6, and 7, the projection engaging surface 50 may be fixedly associated with the trigger back surface 70. The projection engaging surface 50 may be on the trigger back surface 70. The projection engaging surface 50 may extend outwardly from the trigger back surface 70. The projection engaging surface 50 may extend outwardly from the trigger back surface 70 in a direction perpendicular to the nozzle cover 20 central axis 40.

The projection engaging surface 55 may be fixedly associated with the trigger back surface 70 and as such, when the trigger 60 is moved, the projection engaging surface 55 may move. When the spray dispenser 5 is in the discharge locked position 36 and an outside force is placed on the trigger 60, the projection engaging surface 55, as an extension of the trigger 60, may come into contact with the projection 35. When the projection engaging surface 50 comes into contact with the projection 35, the projection engaging surface 50 may be unable to move any further, and as such, the trigger 60 may be unable to move any further. The inhibition of movement of the trigger 60 may not allow for the trigger 60 to be actuated and in turn, actuate the pump 25. As the inhibition of movement of the trigger 60 is due to the blockage of movement by a physical barrier, namely the engagement of the projection 35 and the projection engaging surface 50, this inhibition can be interpreted as a mechanical inhibition. This mechanical inhibition of the actuation of the trigger 60 and thus the actuation of the pump 25 is particularly beneficial for use in spray dispensers having buffer systems, such as those sold under the tradename FLAIROSOL manufactured and sold by Afa Dispensing Group, Helmond, The Netherlands. In spray dispensers having buffer systems, each actuation of the trigger, even slightly, may cause an increase of liquid to flow into the buffer system. This increase of liquid into the buffer system may cause a greater pressure in the buffer system until the liquid is discharged through a nozzle out of the spray dispenser. When there is a barrier to the nozzle flow path and the trigger is capable of being actuated, more liquid may flow into the buffer system and the pressure may increase; however, liquid is unable to be released through the nozzle. If the pressure build-up is too great, there may be damage to the spray dispenser system. As such, the mechanical inhibition of the actuation of the trigger 60 of the present invention may be particularly beneficial to spray dispensers having buffer systems.

For spray dispensers not having buffer systems, when there is blockage of the nozzle flow pathway, there may be a residual quantity of liquid that remains in the nozzle after the user blocks the nozzle flow pathway. This residual quantity of liquid may still be discharged if the trigger is actuated, or may leak out of the nozzle, which is undesirable to users and may harm the user's product experience and waste liquid. Further, there may be sputtering of the liquid or an uneven liquid spray pattern upon use after the user removes the barrier to the nozzle flow pathway and uses the spray dispenser. The mechanical inhibition of the actuation of the trigger 60 of the present invention may resolve such undesirable possibilities by inhibiting discharge of the spray dispenser 5 without having to use a barrier to block liquid, such as liquid composition 6, flow in the nozzle flow path and as such, there may be little to substantially no liquid composition 6 build up in the nozzle flow path. As such, the mechanical inhibition of the actuation of the trigger 60 of the present invention may be beneficial in providing a more consistent spray pattern and better user experience as compared to spray dispensers that inhibit liquid discharge by blocking the nozzle flow path.

As shown in FIG. 4, when the projection 35 is engaged with the projection engaging surface 50, or when the spray dispenser 5 is in the discharge locked position 36, at least a portion of the projection 35 may be directly beneath the projection engaging surface 50. When at least a portion of the projection 35 is directly beneath the projection engaging surface 50, the trigger 60 may not be actuated because the projection engaging surface 50 will not be able to overcome the upwards force the projection 35 is placing against the projection engaging surface 50 as the user attempts to place a downward force on the trigger 60. The portion of the projection 35 directly beneath the projection engaging surface 50 of sufficient size, shape, and material known to one skilled in the art to overcome the force the projection engaging surface 50 places against the projection 35 by way of outside force on the trigger 60.

As shown in FIG. 4, when the projection 35 is engaged with the projection engaging surface 50, or when the spray dispenser 5 is in the discharge locked position 36, and no active outside force is acting on the trigger 60, the projection 35 may be in direct contact with the projection engaging surface 50. When the projection 35 is engaged with the projection engaging surface 50, or when the spray dispenser 5 is in the discharge locked position 36, and no active outside force is acting on the trigger 60, the less distance between the projection 35 and the projection engaging surface 50, the less the movable part 63 of the trigger 60 can move when a force acts upon the trigger 60. Alternatively, when the projection 35 is engaged with the projection engaging surface 50, or when the spray dispenser 5 is in the discharge locked position 36, and no active outside force is acting on the trigger 60, the projection 35 may not be in direct contact with the projection engaging surface 50 (not shown).

As shown in FIG. 4, when the projection 35 is engaged with the projection engaging surface 50, or when the spray dispenser 5 is in the discharge locked position 36, the projection 35 may be proximal the projection engaging surface 50. When the projection 35 is engaged with the projection engaging surface 50, or when the spray dispenser 5 is in the discharge locked position 36, the projection 35 being proximal the projection engaging surface 50 may provide the benefit of less wear on the projection 35 and/or the projection engaging surface 50 as the user repeatedly re-engages the projection 35 with the projection engaging surface 50 through use of rotating the nozzle cover 20.

As shown in FIG. 4, when the spray dispenser 5 is in the trigger first position 61, the projection 35 may be engaged with the projection engaging surface 50. The projection 35 may be posterior the trigger 60 in the discharge locked position 36 to mechanically inhibit actuation of the pump 25 by actuation of the trigger 60. As shown in FIG. 5, when the spray dispenser 5 is in the trigger first position 61, the projection 35 may be disengaged with the projection engaging surface 50.

As shown in FIG. 4, when the projection 35 is engaged with the projection engaging surface 50, or when the spray dispenser 5 is in the discharge locked position 36, the entirety of the projection 35 may be below the shroud top surface 15. When the projection 35 is engaged with the projection engaging surface 50, or when the spray dispenser 5 is in the discharge locked position 36, the entirety of the projection 35 may be directly behind the trigger back surface 70. When the projection 35 is engaged with the projection engaging surface 50, or when the spray dispenser 5 is in the discharge locked position 36, the entirety of the projection 35 may be between the trigger lateral edges 75. When the projection 35 is engaged with the projection engaging surface 50, or when the spray dispenser 5 is in the discharge locked position 36, the entirety of the projection 35 may be below the shroud top surface 15, behind the trigger back surface 70, and between the trigger lateral edges 75. When the projection 35 is engaged with the projection engaging surface 50, or when the spray dispenser 5 is in the discharge locked position 36, the projection 35 may be directly beneath the projection engaging surface 50.

As shown in FIG. 5, when the projection 35 is disengaged with the projection engaging surface 50, or when the spray dispenser 5 is in the discharged unlocked position 37, the entirety of the projection 35 may be below the shroud top surface 15. When the projection 35 is disengaged with the projection engaging surface 50, or when the spray dispenser 5 is in the discharged unlocked position 37, the entirety of the projection 35 may be directly behind the trigger back surface 70. When the projection 35 is disengaged with the projection engaging surface 50, or when the spray dispenser 5 is in the discharged unlocked position 37, the entirety of the projection 35 may be between the trigger lateral edges 75. When the projection 35 is disengaged with the projection engaging surface 50, or when the spray dispenser 5 is in the discharge unlocked position 37, the entirety of the projection 35 may be below the shroud top surface 15, behind the trigger back surface 70, and between the trigger lateral edges 75. When the projection 35 is disengaged with the projection engaging surface 50, or when the spray dispenser 5 is in the discharge unlocked position 37, the projection 35 may be directly beneath the projection engaging surface 50. As shown in FIG. 5, when the projection 35 is disengaged with the projection engaging surface 50, or when the spray dispenser 5 is in the discharge unlocked position 37, the projection 35 may not be in direct contact with the projection engaging surface 50.

As shown in FIGS. 4 and 5, when the spray dispenser 5 is in the trigger first position 61, or the trigger 60 is relaxed, the projection 35 may be obscured from view from one or more directions. When the nozzle orifice 33 is facing the user, the projection 35 may be obscured form view from the direction of the user looking at the nozzle orifice 33 if the trigger front surface 65 is sufficiently opaque and of a size and shape to obscure the projection 35. When the nozzle orifice 33 is facing the user, the projection 35 may be obscured from view from each direction horizontally perpendicular to that of the user looking at the nozzle orifice 33 if the trigger lateral edges 75 are sufficiently opaque and the trigger lateral edges 75 are of a size and shape to hide the projection 35.

The projection 35 in any of the above placements may provide for visual and aesthetic benefit to a user in that the projection 35 appears to be obscured and out of a user's line of sight when the spray dispenser 5 is in the trigger first position 61, both when the spray dispenser 5 is in the discharge locked position 36 as in FIG. 4, and when the spray dispenser 5 is in the discharge unlocked position 37, as in FIG. 5. The projection 35 in any of the above placements may provide for less damage to the projection 35 in that the projection 35 is protected from outside force as the trigger 60 may be in front of the projection 35 and the shroud 10 may be behind the projection 35 in the trigger first position 61, both when the spray dispenser 5 is in the discharge locked position 36 as in FIG. 4, and when the spray dispenser 5 is in the discharge unlocked position 37, as in FIG. 5.

As shown in FIGS. 6 and 7, when the projection 35 is disengaged with the projection engaging surface 50, or when the spray dispenser 5 is in the discharge unlocked position 37, and when the trigger 60 is depressed, or when the spray dispenser 5 is in the trigger second position 62, the projection engaging surface 50 may be unobscured from view from one or more directions. The projection 35 in any of the above placements may provide for less damage to the projection 35 in that the projection 35 is protected from outside force as the shroud 10 is behind the projection 35 when the trigger 60 is in the trigger second position 62. The projection 35 being unobscured from view from one or more directions when the spray dispenser 5 is in the trigger second position 62 may communicate to the user how the trigger 60 is mechanically inhibited from movement when the spray dispenser 5 is in the discharge locked position 36, and whether the projection 35 has any damage, as the user may see the projection 35 and projection engaging surface 50.

Indicator

As shown in FIGS. 8 and 9, the spray dispenser 5 may comprise an indicator 80. The indicator 80 may indicate to the user when the projection 35 is engaged with the projection engaging surface 50 or the spray dispenser 5 is in the discharge locked position 36 and when the projection 35 is disengaged with the projection engaging surface 50 or the spray dispenser 5 is in the discharge unlocked position 37.

As shown in FIG. 8, the indicator 80 may comprise an indicator locked position 81 wherein the indicator 80 may be misaligned to indicate that the spray dispenser 5 is not ready for use because the projection 35 is engaged with the projection engaging surface 50 and the trigger 60 is mechanically inhibited from actuation or that the spray dispenser 5 is in the discharge locked position 36.

As shown in FIG. 9, the indicator 80 may comprise an indicator unlocked position 82 wherein the indicator 80 may be aligned to indicate that the spray dispenser 5 is ready for use because the projection 35 is disengaged with the projection engaging surface 50 and the trigger 60 is not mechanically inhibited from actuation or that the spray dispenser 5 is in the discharge unlocked position 37.

As shown in FIGS. 8 and 9, the indicator 80 may be on both the shroud top surface 15 and the nozzle cover 20. Alternatively, the indicator 80 may be on only the nozzle cover 20. As shown in FIGS. 8 and 9, the indicator 80 may be a shape, such as a substantially rectangular shape as shown, printed upon or etched within the shroud top surface 15, the nozzle cover 20, or both the shroud top surface 15 and the nozzle cover 20, such that the rotation of the nozzle cover 20 may communicate whether the spray dispenser 5 is in the discharge locked position 36 or in the discharge unlocked position 37. The indicator 80 may be any shape, marking, and/or mechanism known to one skilled in the art capable of indicating to the user when the spray dispenser 5 is in the discharge locked position 36 or in the discharge unlocked position 37, such as, for example, an arrow, a color, a line, an etching, a word such as "on" or "off", and any other shape, marking, and/or mechanism known to one skilled in the art. The indicator 80 may comprise a combination of shapes, markings, and/or mechanisms known to one skilled in the art capable of indicating to the user when the spray dispenser 5 is in the discharge locked position 36 or in the discharge unlocked position 37, such as, for example, a yellow substantially rectangular shaped indicator 80 on a white nozzle cover 20 and on a white shroud top surface 15 where the alignment and misalignment of each yellow substantially rectangular shape indicates the spray dispenser 5 is either in the discharge locked position 36 or in the discharge unlocked position 37.

Liquid Composition

The liquid dispensing product 3 may comprise a liquid composition 6. The liquid composition 6 may be housed within the container 7 attached to the spray dispenser 5 before actuation of the spray dispenser 5.

The liquid composition 6 may comprise any component found in a liquid composition known to one skilled in the art to clean surfaces, such as dishware, sinks, countertops, and clothing, or any other surface found in a household. The liquid composition 6 may be a liquid composition 6 such as any such composition discussed in U.S. Publications 2017/0015953 A1, 2017/0015940 A1, 2017/0015962 A1, 2017/0015961 A1, 2017/0015941 A1, or 2017/0015960 A1, incorporated herein by reference.

The liquid composition 6 may be a cleaning composition. The liquid composition 6 may be a hand dishwashing cleaning product. The liquid composition 6 may be an air freshener, a pesticide, an insecticide, a hard surface cleaner, and/or any other household liquid composition. The liquid composition 6 may be any other liquid composition known to one skilled in the art of use with a spray dispenser 5.

The liquid composition 6 may comprise from about 5% to about 15%, by weight of the liquid composition 6, of a surfactant system. The liquid composition 6 may comprise from about 6% to about 14%, by weight of the liquid composition 6, of a surfactant system. The liquid composition 6 may comprise from about 7% to about 12%, by weight of the liquid composition 6, of a surfactant system.

The surfactant system may comprise an anionic surfactant. The surfactant system may further comprise a co-surfactant selected from the group consisting of amphoteric surfactants, zwitterionic surfactants, and mixtures thereof. The surfactant system can optionally comprise a non-ionic surfactant and/or a cationic surfactant.

Assembly of Liquid Dispensing Products

As shown in FIGS. 10-13, the liquid dispensing product 3 may be an assembly of liquid dispensing products 4. The assembly of liquid dispensing products 4 may mean at least two individual liquid dispensing products 3. The assembly of liquid dispensing products 4 may be presented to a consumer on a shelf, product display, or other arrangement suitable for presenting consumer products to a consumer in a retail environment. The assembly of liquid dispensing products 4 may be presented to a consumer and/or to a retailer in a shipping material, such as for example, in shipping wrap or in a receptacle.

The assembly of liquid dispensing products 4 can be, by way of non-limiting example, a plurality of liquid dispensing products 3 according to the present invention. The assembly of liquid dispensing products 4 can be, by way of non-limiting example, a plurality of liquid dispensing products 3 according to the present invention wherein at least one individual liquid dispensing product 3 may be distinct in at least one aspect from any other individual liquid dispensing product 3 in the assembly 4, such as, for example, whereas one liquid dispensing product 3 is in the discharge locked position 36 and another liquid dispensing product 3 is in the discharge unlocked position 37. The assembly of liquid dispensing products 4 can be, by way of non-limiting example, a plurality of liquid dispensing products 3 according to the present invention wherein each of the individual liquid dispensing products 3 is indistinct from any other of the individual liquid dispensing products 3 in the assembly 4.

Method of Shipping

A method of shipping one or more liquid dispensing products 3 is set forth herein.

The method of shipping one or more liquid dispensing products 3 may comprise the steps of providing one or more liquid dispensing products 3. The step of providing one or more liquid dispensing products 3 may comprise providing an assembly of liquid dispensing products 4. The liquid dispensing products 3 may be according to the present invention.

After the step of providing one or more liquid dispensing products 3, the method of shipping one or more liquid dispensing products 3 may further comprise the step of facilitating the transfer of the one or more liquid dispensing products 3 from a first geographical address to a second geographical address. A geographical address need not be a formal address but may be any geographic coordinates. The step of facilitating the transfer of the one or more liquid dispensing products 3 from a first geographical address to a second geographical address can be, by way of non-limiting example, moving the one or more liquid dispensing products 3 on a vehicle, such as a car or truck, or by any other mode of transportation, including but not limited to, a train, a bus, an airplane, a water vessel, by a human, by a non-human. The step of facilitating the transfer of the one or more liquid dispensing products 3 from a first geographical address to a second geographical address may be as simple as a human carrying one or more liquid dispensing products 3 one or more steps.

The method of shipping one or more liquid dispensing products 3 further comprises that the spray dispenser 5 of at least one of the individual liquid dispensing products 3 is in the discharge locked position 36. The method of shipping one or more liquid dispensing products 3 may comprise that the spray dispenser 5 of all of the one or more liquid dispensing products 3 is in the discharge locked position 36. It is beneficial for at least one of the individual liquid dispensing products 3 or for all of the individual liquid dispensing products 3 to be in the discharge locked position 36 such that the spray dispenser 5 does not accidentally actuate during the facilitation of the transfer of the one or more liquid dispensing products 3 from one geographical address to a second geographical address. Accidental actuation of the liquid dispensing product 3 may result in unwanted liquid composition 6 discharge on that particular spray dispenser 5 and/or the container 7, and/or on one or more separate spray dispenser 5 and/or container 7, such that such accidental actuation results in unwanted contact with the liquid composition 6 by a person and/or loss of the liquid composition 6, either of which may potentially cause a poor experience to the recipient of the transfer of the one or more liquid dispensing products 3.

As shown in FIGS. 10, 11, and 12, the step of facilitating the transfer of one or more liquid dispensing products 3 from a first geographical address to a second geographical address may comprise wherein at least one of the liquid dispensing products 3 may be at least partially in contact with a shipping material 39 for any duration of time. The step of the transfer of one or more liquid dispensing products 3 from a first geographical address to a second geographical address may comprise wherein at least one of the liquid dispensing products 3 may be at least partially in contact with a shipping material 39 for any duration of time may comprise that the spray dispenser of all of the one or more liquid dispensing products 3 is in the discharge locked position 36.

As shown in FIG. 10, the shipping material 39 may comprise shipping wrap 41, wherein at least one of the liquid dispensing products 3 is at least partially in contact with the shipping wrap 41. The shipping material 39 may comprise shipping wrap 41, wherein each of the individual liquid dispensing products 3 is at least partially in contact with the shipping wrap 41. Shipping wrap 41 may comprise by way of non-limiting example, plastic, stretch film, and/or tape. The shipping wrap 41 may be wrapped around one or more of the liquid dispensing products 3 to keep the one or more liquid dispensing products 3 bound together for ease of facilitating the transfer from a first geographical address to a second geographical address, such as to stabilize, protect, and/or secure the one or more liquid dispensing products 3. Shipping wrap 41 may comprise any such material known to one skilled in the art to be used in conjunction with shipping a liquid dispensing product 3.

As shown in FIG. 11, the shipping material 39 may comprise a receptacle 42, wherein at least one of the liquid dispensing products 3 is at least partially in contact with, at least partially on top of, and/or at least partially within the receptacle 42. This arrangement may be beneficial when stacking the individual liquid dispensing products 3 to provide for a greater number of individual liquid dispensing products 3 to fit within the space and/or the benefit of curtailing the quantity and/or amount of shipping materials for shipping or movement of the assembly of one or more liquid dispensing products 4.

As shown in FIG. 12, all of the individual liquid dispensing products 3 of the assembly of one or more liquid dispensing products 4 may be placed at least partially on top of and/or within the receptacle 42. This arrangement may be beneficial when shipping or moving a fewer number of individual liquid dispensing products 3 as each individual liquid dispensing product 3 may be stabilized by being at least partially in contact with the receptacle 42.

The receptacle 42 may be any such object or space used to contain the one or more liquid dispensing products 3. The receptacle 42 may be a box or carton. The receptacle 42 may be a pallet or any type of transport structure. The receptacle 42 may be any such object or space used to contain one or more of the liquid dispensing products 3 together for ease of facilitating the transfer from a first geographical address to a second geographical address, such as to stabilize, protect, and/or secure the one or more liquid dispensing products 3.

As shown in FIGS. 13 and 14, the assembly of one or more liquid dispensing products 4 may be placed on a shelf 43, such as that of a store shelf for display to potential consumers. As shown in FIG. 13, when placed on a shelf 43, the assembly of one or more liquid dispensing products 4 may be displayed such a trigger lateral edge 75 faces the consumer. Displaying the assembly of one or more liquid dispensing products 4 wherein the trigger lateral edge 75 faces the consumer may be beneficial in demonstrating the ergonomic and sophisticated curvature of the trigger 60 and/or may be aesthetically appealing to potential consumers. As shown in FIG. 14, when placed on a shelf 43, the assembly of one or more liquid dispensing products 4 may be displayed such that the trigger 60 faces the consumer. Displaying the assembly of one or more liquid dispensing products 4 wherein the trigger 60 faces the consumer may be beneficial in consolidating shelf space, such as, for example, if the trigger 60 is of a length to extend further than the outer boundary of the container 7.

Method of Use

A method for using a liquid dispensing product 3 comprising a spray dispenser 5 and a liquid composition 6, wherein the spray dispenser 5 comprises a trigger locking mechanism, to spray the liquid composition 6 is set forth herein.

The method of using the liquid dispensing product 3 may be performed by a user or by a machine. When the method is performed by a user, the user may hold the spray dispenser 5 in one hand, for example, the user's right hand. The user's hand may wrap around the shroud 10 such that the user's right index finger may be on the trigger front surface 65 and the rest of the user's fingers may lie on the shroud 10 beneath the trigger 60. Before beginning the method, the spray dispenser 5 may be such that the projection 35 is engaged with the projection engaging surface 50 or that the spray dispenser 5 is in the discharge locked position 36. The spray dispenser may have an indicator 80 having an indicator locked position 81 and an indicator unlocked position 82. The indicator 80 may be on the nozzle cover 20 and/or on the shroud top surface 15. The indicator 80 may be on at least the nozzle cover 20, and preferably may be on the nozzle cover 20 and on the shroud top surface 15. The indicator 80 may be in an indicator locked position 81, indicating to the user that the trigger 60 is mechanically inhibited from movement, i.e., is in the discharge locked position 36, and the spray dispenser 5 will not discharge the liquid composition 6.

The method of using the liquid dispensing product 3 may comprise the step of first rotating the nozzle cover 20 in a first direction such that the projection 35 fixedly associated with the nozzle cover 20 is disengaged from the projection engaging surface 50 fixedly associated with the trigger back surface 70. The user may perform this step by rotating the nozzle cover 20 counterclockwise with the user's left thumb and index finger to disengage the projection 35 from the projection engaging surface 50, or move the trigger 60 to the discharge unlocked position 37. When the projection 35 is disengaged from the projection engaging surface 50, the spray dispenser 5 may be in the discharge unlocked position 37 such that the trigger 60 is no longer mechanically inhibited from actuation. The first direction may be in the counter-clockwise direction from the perspective of the user facing the nozzle orifice 33. Alternatively, the first direction may be in the clockwise direction from the perspective of the user facing the nozzle orifice 33. The nozzle cover 20 may be rotated about 120 degrees or less, preferably 90 degrees or less, even more preferably 60 degrees or less, most preferably 45 degrees or less in the first direction. The nozzle cover 20 may be rotated any degrees necessary for the projection 35 to disengage from the projection engaging surface 50. The nozzle cover 20 may be rotated in the first direction until the indicator 80 is in the indicator unlocked position 82.

The method of using the liquid dispensing product 3 may further comprise the step of aiming the spray dispenser 5 at a targeted surface. The targeted surface may be a solid surface such as a kitchen counter, a bathroom sink, or a human hand or it may be a targeted area such as into the air. The targeted surface may be any such surface capable of receiving a sprayed liquid, such as that of the liquid composition 6. The targeted surface may be dishware and/or tableware. The targeted surface may be a cleaning implement, for example, a sponge and/or a cloth. At this point in the method, the trigger 60 may be in the trigger first position 61 or the trigger 60 is relaxed.

The method of using the liquid dispensing product 3 then further comprises the step of depressing the trigger 60 to actuate the pump 25. The step of depressing the trigger 60 is preferably after the step of aiming the spray dispenser 5 at a targeted surface so that the liquid composition 6 is sprayed where the user intends for the liquid composition 6 to be sprayed. The step of depressing the trigger 60 may be done by the user placing a force against the movable part 63 of the trigger 60 using the user's own hand or by use of mechanical means to place a force against the trigger 60. The trigger 60 may be movable in at least an axially downward direction and the trigger 60 may be depressed in at least an axially downward direction, or, alternatively, in a direction towards the shroud 10, to actuate the pump 25. The step of depressing the trigger 60 may be done by any means known to one skilled in the art to depress or actuate a trigger 60. At this point in the method, the trigger 60 may be in the trigger second position 62, or the trigger 60 is depressed. The actuation of the trigger 60 may actuate the pump 25. The actuation of the pump 25 may cause liquid to spray out of the spray dispenser 5 through the discharge nozzle 30 onto a surface external to the liquid dispensing product 3.

The method of using a liquid dispensing product 3 may comprise the step of the user determining the allotment of liquid composition 6 the user desires to discharge and determining that the desired allotment of liquid composition 6 discharged has been attained. After the step of determining the desired allotment of liquid composition 6 discharged and determining that the desired allotment of liquid discharged has been attained, the method may further comprise the step of subsequently releasing the trigger 60 to terminate actuation of the pump 25. When the user releases the trigger 60, the trigger 60 may move in at least axially upwards direction, or alternatively, away from the shroud 10. At this point in the method, the release of the trigger 60 may cause the trigger 60 to return to the trigger first position 61 where the trigger 60 is relaxed.

Following the step of releasing the trigger 60 to terminate actuation of the pump 25, the method may comprise the repetition of the steps of aiming the spray dispenser 5 at a targeted surface, depressing the trigger 60 to actuate the pump 25, determining the allotment of liquid composition 6 the user desires to discharge and determining that the desired allotment of liquid composition 6 discharged has been attained, and releasing the trigger 60 to terminate actuation of the pump 25, for as many repetitions the user desires until attaining the desired liquid composition 6 allotment and/or spray coverage the user desires.

Once the user has determined the user is finished using the liquid dispensing product 3 in the given circumstance and the trigger 60 is in the trigger first position 61 or the trigger 60 is relaxed, the method may further comprise the step of rotating the nozzle cover 20 in a second direction opposite the first direction such that the projection 35 is engaged with the projection engaging surface 50, i.e., is in the discharge locked position 36. To accomplish this step, still holding the spray dispenser 5 in the user's right hand, the user may rotate the nozzle cover 20 clockwise with the user's left thumb and index finger to engage the projection 35 with the projection engaging surface 50. When the projection 35 is engaged with the projection engaging surface 50, the spray dispenser 5 may be in the discharge locked position 36 such that the trigger 60 is mechanically inhibited from actuation. The nozzle cover 20 may be rotated any degrees necessary for the projection 35 to engage with the projection engaging surface 50. The second direction may be in the clockwise direction from the perspective of the user facing the nozzle orifice 33. Alternatively, the second direction may be in the counter-clockwise direction from the perspective of the user facing the nozzle orifice 33. The nozzle cover 20 may be rotated about 120 degrees or less, preferably 90 degrees or less, even more preferably 60 degrees or less, most preferably 45 degrees or less in the second direction. The nozzle cover 20 may be rotated in the second direction until the indicator 80 is in the indicator locked position 81, indicating to the user that the spray dispenser 5 is locked and unable to spray, i.e., is in the discharge locked position 36.

The method may further comprise the step of the storing the liquid dispensing product 3 in a storage space. The user may place the liquid dispensing product 3 in a cabinet or by the user's sink until the next time the user decides to use the liquid dispensing product 3.

Combinations

A. A liquid dispensing product 3 comprising:
- a spray dispenser 5, said spray dispenser comprising:
  - a shroud 10 housing a pump 25, wherein said shroud comprises a shroud top surface 15;
  - a rotatable nozzle cover 20 housing a discharge nozzle 30, wherein said discharge nozzle is in fluid communication with said pump and wherein said nozzle cover is rotatable about a central axis 40 thereof;
  - a trigger 60 operatively engaged with said pump, said trigger having a trigger front surface 65 facing away from said shroud and an opposing trigger back surface 70 and a pair of opposing trigger lateral edges 75;
  - a projection 35 extending outwardly from said nozzle cover; and
  - a projection engaging surface 50 on said trigger back surface, wherein said projection is rotatably engageable with said projection engaging surface and wherein the entirety of said projection is below said shroud top surface, behind said trigger back surface, and between said trigger lateral edges when said projection is engaged with said projection engaging surface and when said projection is disengaged with said projection engaging surface; and a liquid composition 6 comprising from about 5% to about 15%, by weight of said composition, of a surfactant system;

wherein said spray dispenser is configured to spray said composition.

B. A liquid dispensing product according to paragraph A, wherein at least a portion of said projection is directly beneath said projection engaging surface when said projection is engaged with said projection engaging surface.

C. A liquid dispensing product according to any one of paragraphs A or B, wherein said projection is in direct contact with said projection engaging surface when said projection is engaged with said projection engaging surface.

D. A liquid dispensing product according to any one of paragraphs A to C, wherein said spray dispenser comprises a trigger first position 61 wherein said trigger is relaxed and a trigger second position 62, wherein said trigger is depressed, wherein said projection is obscured from view from one or more directions when said spray dispenser is in said trigger first position.

E. A liquid dispensing product according to paragraph D, wherein said projection is engaged with said projection engaging surface when said spray dispenser is in said trigger first position.

F. A liquid dispensing product according to paragraph D, wherein said projection is unobscured from view from one or more directions when said spray dispenser is in said trigger second position.

G. A liquid dispensing product according to any one of paragraphs A to F, wherein said trigger is movable in at least an axially downward direction.

H. A liquid dispensing product according to any one of paragraphs A to G, wherein said shroud top surface comprises an indicator, said indicator comprising an indicator locked position 81 and an indicator unlocked position 82, wherein said projection is engaged with said projection engaging surface when said indicator is in said indicator locked position.

I. A liquid dispensing product according to any one of paragraphs A to H, wherein said nozzle cover is rotatable about a central axis thereof between a discharge locked position 36 and a discharge unlocked position 37, wherein said projection is posterior said trigger in said discharge locked position to mechanically inhibit trigger actuation of said pump.

J. A liquid dispensing product according to paragraph I, wherein said nozzle cover is undirectionally rotatable to said discharge locked position.

K. A liquid dispensing product according to any one of paragraphs I or J, wherein said nozzle cover is rotatable about 120 degrees or less, preferably about 90 degrees or less, most preferably about 60 degrees or less, most preferably 45 degrees or less from said discharge unlocked position to said discharge locked position.

L. An assembly of liquid dispensing products 4, each member of said assembly individually being a liquid dispensing product according to any one of paragraphs A to K.

M. A method of shipping one or more liquid dispensing products according to any one of paragraphs A to L, said method comprising the steps of:

providing one or more of said liquid dispensing products;

facilitating the transfer of said one or more liquid dispensing products from a first geographical address to a second geographical address;

wherein said spray dispenser of at least one of said liquid dispensing products, preferably of all of said liquid dispensing products, is in said discharge locked position.

N. A method of shipping according to paragraph M, wherein said step of facilitating the transfer of said one or more liquid dispensing products from said first geographical address to said second geographical address comprises at least one of said liquid dispensing products at least partially in contact with a shipping material 39 for any duration of time.

O. A method of shipping according to paragraph N, wherein said shipping material comprises shipping wrap 41 and/or a receptacle 42, wherein at least one of said liquid dispensing products is at least partially in contact with said shipping wrap and/or wherein at least one of said liquid dispensing products is placed at least partially on top of and/or at least partially within said receptacle.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid dispensing product comprising:

a spray dispenser, said spray dispenser comprising:

a shroud housing a pump, wherein said shroud comprises a shroud top surface;

a rotatable nozzle cover housing a discharge nozzle, wherein said discharge nozzle is in fluid communication with said pump and wherein said nozzle cover is rotatable about a central axis thereof;

a trigger operatively engaged with said pump, said trigger having a trigger front surface facing away from said shroud and an opposing trigger back surface and a pair of opposing trigger lateral edges;

a projection extending outwardly from said nozzle cover; and a projection engaging surface on said trigger back surface, wherein said projection is rotatably engageable with said projection engaging surface and wherein the entirety of said projection is below said shroud top surface, behind said trigger back surface, and between said trigger lateral edges when said projection is engaged with said projection engaging surface and when said projection is disengaged with said projection engaging surface; and a liquid composition comprising from about 5% to about 15%, by weight of said composition, of a surfactant system;

wherein said spray dispenser is configured to spray said composition.

2. The liquid dispensing product according to claim 1, wherein said projection comprises a hook.

3. The liquid dispensing product according to claim 1, wherein said projection engaging surface comprises a tab.

4. The liquid dispensing product according to claim 1, wherein at least a portion of said projection is directly beneath said projection engaging surface when said projection is engaged with said projection engaging surface.

5. The liquid dispensing product according to claim 4, wherein said projection is in direct contact with said projection engaging surface when said projection is engaged with said projection engaging surface.

6. The liquid dispensing product according to claim 1, wherein said spray dispenser comprises a trigger first position wherein said trigger is relaxed and a trigger second position wherein said trigger is depressed, wherein said projection is obscured from view from one or more directions when said spray dispenser is in said trigger first position.

7. The liquid dispensing product according to claim 6, wherein said projection is engaged with said projection engaging surface when said spray dispenser is in said trigger first position.

8. The liquid dispensing product according to claim 6, wherein said projection is unobscured from view from one or more directions when said spray dispenser is in said trigger second position.

9. The liquid dispensing product according to claim 1, wherein said trigger is movable in at least an axially downward direction.

10. The liquid dispensing product according to claim 1, wherein said shroud top surface comprises an indicator, said indicator comprising an indicator locked position and an indicator unlocked position, wherein said projection is engaged with said projection engaging surface when said indicator is in said indicator locked position.

* * * * *